US005880750A

United States Patent [19]

Takahashi

[11] Patent Number: 5,880,750

[45] Date of Patent: Mar. 9, 1999

[54] INK-JET APPARATUS HAVING A PRELIMINARY PULSE SIGNAL AND A JET PULSE SIGNAL AND A DRIVING METHOD THEREOF

[75] Inventor: Yoshikazu Takahashi, Nagoya, Japan

[73] Assignee: Brother Kogyo Kabushiki Kaisha, Nagoya, Japan

[21] Appl. No.: 665,533

[22] Filed: Jun. 18, 1996

[30] Foreign Application Priority Data

Jul. 18, 1995 [JP] Japan ..... 7-181645

[51] Int. Cl.[6] ..... B41J 29/38

[52] U.S. Cl. ..... 347/10; 347/11

[58] Field of Search ..... 347/10, 11, 68–72, 347/15

[56] References Cited

U.S. PATENT DOCUMENTS

| | | | |
|---|---|---|---|
| 3,946,398 | 3/1976 | Kyser et al. | 347/68 X |
| 4,266,232 | 5/1981 | Juliana, Jr. et al. | 347/68 X |
| 4,369,455 | 1/1983 | McConica et al. | 347/11 |
| 4,879,568 | 11/1989 | Bartky et al. | 347/69 |
| 4,982,199 | 1/1991 | Dunn | 347/15 |
| 5,764,256 | 1/1998 | Zhang | 347/71 |

FOREIGN PATENT DOCUMENTS

A-55-27282 2/1980 Japan .

*Primary Examiner*—Benjamin R. Fuller
*Assistant Examiner*—C. Dickens
*Attorney, Agent, or Firm*—Oliff & Berridge, PLC

[57] ABSTRACT

A drive waveform consists of a jet pulse signal A for ejecting ink and a preliminary pulse signal B for causing preliminary variations in a pressure within an ink flow passage before the ink is ejected. The jet pulse signal A and the preliminary pulse signal B have the same peak value (a voltage) E(V). The width WA of the jet pulse signal A is identical with time T during which a pressure wave uni-directionally travels along the inside of the ink flow passage, and the width WB of the preliminary pulse signal B is twice the uni-directional propagation time T within the ink flow passage. A delay time TD between time TE at which the preliminary pulse signal B falls and time TS at which the jet pulse signal A rises, is half the time T during which the pressure wave uni-directionally travels along the inside of the ink flow passage. The invention makes it possible to implement an inexpensive ink-jet apparatus and a driving method thereof which provide a required volume of ink droplet and superior print quality.

20 Claims, 11 Drawing Sheets

Fig.6

| TD (XT) / WB (XT) | 0.3 | | 0.5 | | 1.0 | | 1.5 | | 2.0 | | 2.5 | | 3.0 | |
|---|---|---|---|---|---|---|---|---|---|---|---|---|---|---|
| | SPEED | VOLUME | SPEED | VOLUME | SPEED | VOLUME | SPEED | VOLUME | SPEED | VOLUME | SPEED | VOLUME | SPEED | VOLUME |
| 0.3 | 5.1 | 43 | 5.1 | 43 | 5.1 | 43 | 5.1 | 43 | 5.0 | 43 | 5.0 | 43 | 5.0 | 43 |
| 0.4 | X | X | X | X | X | X | X | X | X | X | X | X | X | X |
| 0.5 | X | X | X | X | X | X | X | X | X | X | X | X | X | X |
| 0.6 | X | X | X | X | X | X | X | X | X | X | X | X | X | X |
| 0.7 | X | X | X | X | X | X | X | X | X | X | X | X | X | X |
| 0.8 | X | X | X | X | X | X | X | X | X | X | X | X | X | X |
| 1.0 | X | X | X | X | X | X | X | X | X | X | X | X | X | X |
| 1.5 | X | X | X | X | X | X | X | X | X | X | X | X | X | X |
| 1.6 | X | X | X | X | X | X | X | X | X | X | X | X | X | X |
| 1.7 | 5.0 | 45 | 5.0 | 45 | 5.0 | 45 | 5.0 | 45 | 5.0 | 45 | 5.0 | 45 | 5.0 | 45 |
| 1.8 | 5.0 | 45 | 5.0 | 45 | 5.0 | 45 | 5.0 | 45 | 5.0 | 45 | 5.0 | 45 | 5.0 | 45 |
| 2.0 | 5.0 | 45 | 5.0 | 45 | 5.0 | 45 | 5.0 | 45 | 5.0 | 45 | 5.0 | 45 | 5.0 | 45 |
| 2.2 | 5.0 | 45 | 5.0 | 45 | 5.0 | 45 | 5.0 | 45 | 5.0 | 45 | 5.0 | 45 | 5.0 | 45 |
| 2.3 | 5.0 | 45 | 5.0 | 45 | 5.0 | 45 | 5.0 | 45 | 5.0 | 45 | 5.0 | 45 | 5.0 | 45 |
| 2.4 | X | X | X | X | X | X | X | X | X | X | X | X | X | X |
| 2.5 | X | X | X | X | X | X | X | X | X | X | X | X | X | X |
| 3.0 | X | X | X | X | X | X | X | X | X | X | X | X | X | X |
| 3.5 | X | X | X | X | X | X | X | X | X | X | X | X | X | X |
| 3.6 | X | X | X | X | X | X | X | X | X | X | X | X | X | X |
| 3.7 | 5.0 | 46 | 5.0 | 46 | 5.0 | 46 | 5.0 | 46 | 4.9 | 46 | 4.9 | 46 | 4.9 | 46 |
| 3.8 | 5.0 | 46 | 5.0 | 46 | 5.0 | 46 | 5.0 | 46 | 4.9 | 46 | 4.9 | 46 | 4.9 | 46 |
| 4.0 | 5.0 | 46 | 5.0 | 46 | 5.0 | 46 | 5.0 | 46 | 4.9 | 46 | 4.9 | 46 | 4.9 | 46 |
| 4.2 | 5.0 | 46 | 5.0 | 46 | 5.0 | 46 | 5.0 | 46 | 4.9 | 46 | 4.9 | 46 | 4.9 | 46 |
| 4.3 | 5.0 | 46 | 5.0 | 46 | 5.0 | 46 | 5.0 | 46 | 4.9 | 46 | 4.9 | 46 | 4.9 | 46 |
| 4.4 | X | X | X | X | X | X | X | X | X | X | X | X | X | X |
| 4.5 | X | X | X | X | X | X | X | X | X | X | X | X | X | X |
| 5.0 | X | X | X | X | X | X | X | X | X | X | X | X | X | X |
| 5.5 | X | X | X | X | X | X | X | X | X | X | X | X | X | X |
| 5.6 | X | X | X | X | X | X | X | X | X | X | X | X | X | X |
| 5.7 | 4.9 | 47 | 4.9 | 47 | 4.9 | 47 | 4.9 | 47 | 4.8 | 47 | 4.8 | 47 | 4.8 | 47 |
| 5.8 | 4.9 | 47 | 4.9 | 47 | 4.9 | 47 | 4.9 | 47 | 4.8 | 47 | 4.8 | 47 | 4.8 | 47 |
| 6.0 | 4.9 | 47 | 4.9 | 47 | 4.9 | 47 | 4.9 | 47 | 4.8 | 47 | 4.8 | 47 | 4.8 | 47 |
| 6.2 | 4.9 | 47 | 4.9 | 47 | 4.9 | 47 | 4.9 | 47 | 4.8 | 47 | 4.8 | 47 | 4.8 | 47 |
| 6.3 | 4.9 | 47 | 4.9 | 47 | 4.9 | 47 | 4.9 | 47 | 4.8 | 47 | 4.8 | 47 | 4.8 | 47 |
| 6.4 | X | X | X | X | X | X | X | X | X | X | X | X | X | X |
| 6.5 | X | X | X | X | X | X | X | X | X | X | X | X | X | X |
| 7.0 | X | X | X | X | X | X | X | X | X | X | X | X | X | X |
| | m/s | pl | m/s | pl | m/s | pl | m/s | pl | m/s | pl | m/s | pl | m/s | pl |

× : AN INK DROPLET WAS JETTED BY SECOND PULSE

INK-JET APPARATUS HAVING A PRELIMINARY PULSE SIGNAL AND A JET PULSE SIGNAL AND A DRIVING METHOD THEREOF

BACKGROUND OF THE INVENTION

1. Field of the Invention

The invention relates to an ink-jet apparatus and a driving method thereof.

2. Description of Related Art

Non-impact printers are currently expanding their markets, taking the place of impact printers already on the market. Of the various types of non-impact printers, an ink-jet printer is based on the simplest principle and can easily implement multiple gradations and color printing. Among the ink-jet printers, a drop-on-demand ink-jet printer, which ejects only ink droplets to be used in printing, is rapidly coming into wide use because of its superior ejecting efficiency and inexpensive running cost.

A Kyser ink-jet printer disclosed in U.S. Pat. No. 3,946,398 and a thermal-jet printer disclosed in Japanese unexamined Patent Publication No. 55-27282 are known as representative drop-on-demand type ink-jet printers. It is difficult to reduce the size of the former printer, and the ink used in the latter printer is required to have heat resistance because the ink is subjected to a high temperature. For these reasons, each of the printers has its own very difficult problem.

A shear mode jet printer as disclosed in U.S. Pat. No. 4,879,568 that utilizes piezoelectric ceramics is proposed as a new method for solving the problems of the prior art.

As shown in FIGS. 1 and 2, a shear mode ink-jet apparatus 600 comprises a bottom wall 601, a top wall 602, and shear mode actuator walls 603. Each actuator wall 603 is composed of a lower wall 607 which is bonded to the bottom wall 601 and is polarized in the direction designated by an arrow 611, and an upper wall 605 which is bonded to a top wall 602 and is polarized in the direction designated by an arrow 609. Each pair of actuator walls 603 constitutes an ink flow passage 613 between the upper and lower walls. A space 615 which is narrower than the ink flow passage 613 is formed between each adjacent pair of actuator walls 603.

A nozzle plate 617 having a nozzle 618 formed therein is fixedly provided at one longitudinal end of each ink flow passage 613. An electrode 619 is provided on one side of the actuator wall 603 in the form of a metallized layer, and another electrode 621 is provided on the other side of the actuator wall 603, also in the form of a metallized layer. Specifically, the actuator wall 603 of the ink flow passage 613 is provided with the electrode 619, and the actuator wall 603 of the space 615 is provided with the electrode 621. The surface of the electrode 619 is coated with an insulating layer 630 so as to isolate the electrode surface from ink. The electrode 621 is provided so as to face the space 615 and is grounded to an earth ground 623. The electrode 619 provided in the ink flow passage 613 is connected to a control circuit 625 which outputs an actuator drive signal.

The manufacture of the ink-jet apparatus 600 will now be described. A piezoelectric ceramics layer polarized in the direction designated by the arrow 611 is bonded to the bottom wall 601, and a piezoelectric ceramic layer polarized in the direction designated by the arrow 609 is bonded to the top wall 602. The thickness of the respective ceramics layers is substantially equal to the height of the lower wall 607 and the upper wall 605. Parallel notches are then cut in the piezoelectric ceramics layers by rotation of a diamond cutting disk, whereby the lower wall 607 and the upper wall 605 are formed. The electrode 619 is deposited on the side surface of the lower wall 607 by vapor deposition, and the electrode 619 is further coated with the insulating layer 630. Similarly, the electrode 621 is formed on the side surface of the upper wall 605.

The peaks between the notches of the upper wall 605 and the lower wall 607 are bonded together, so that the ink flow passage 613 and the space 615 are formed. The nozzle plate 617 having the nozzle 618 formed therein is bonded to one longitudinal end of each of the ink flow passage 613 and the space 615 in such a way that the nozzle 618 corresponds to the ink flow passage 613. The other longitudinal ends of the ink flow passage 613 and the space 615 are connected to the control circuit 625 and the earth ground 623, respectively.

As a result of the application of a voltage from the control circuit 625 to the electrode 619 of each ink flow passage 613, the actuator wall 603 causes piezoelectric thickness deformation in such a direction that the volume of the ink flow passage 613 increases. For example, if a voltage E (V) is applied to an electrode 619C of an ink flow passage 613C, as shown in FIG. 3, an electric field develops in respective actuator walls 603E and 603F in the directions designated by arrows 627 and 629, as a result of which the actuator walls 603E and 603F cause piezoelectric thickness deformation in such a direction that the volume of the ink flow passage 613C increases. At this time, the pressure within the ink flow passage 613C including the vicinity of a nozzle 618C drops. The decreased pressure is held for time T during which a pressure wave uni-directionally and longitudinally travels along the inside of the ink flow passage 613. During this period, ink is fed from a manifold (not shown) to the ink flow passage 613.

The time T is necessary for the pressure wave to travel along the ink flow passage 613 in a longitudinal direction thereof. The uni-directional propagation time T is determined by the length L of the ink flow passage 613 and the speed of sound "a" in the ink within the ink flow passage 613. Specifically, the uni-directional propagation time T is defined as $T=L/a$.

According to the theory of propagation of pressure waves, the pressure within the ink flow passage 613 is reversed immediately after the time T has elapsed since the application of the pressure, whereupon the pressure changes so as to become positive. The voltage applied to an electrode 619C of the ink flow passage 613C is reset to 0 (V) in accordance with the inversion of the pressure from negative to positive.

As a result, the actuator walls 603E and 603F return to their original states as shown in FIG. 1, and the ink is pressurized. At this time, the pressure that became positive, and the pressure developed as a result of the actuator walls 603E and 603F returning to their original states, are added to each other, and a relatively high pressure develops in the vicinity of the nozzle 618C of the ink flow passage 613C. Eventually, the ink is ejected from the nozzle 618C.

According to the ink-jet apparatus having the above-described construction and a driving method thereof, it is possible to provide the ink within the ink flow passage 613C with such a relatively high pressure as previously mentioned at the moment the ink droplet is squirted from the nozzle 618C.

With reference to FIGS. 4A to 4G, a meniscus of the ink formed in the nozzle 618 will be described. As shown in the drawings, the meniscus of the ink changes with time (t=0–6T).

In FIG. 4B, the meniscus 24 of the ink recedes into the inside of the nozzle 618C. Some of the previously mentioned high pressure developed to eject the ink is wasted in pushing the meniscus 24 back to the nozzle exit, and hence the high pressure that contributes to the ejecting of the ink droplets is reduced. For this reason, if it is necessary to eject a large amount of ink, the required volume of the ink will not be obtained, thereby resulting in poor print quality.

SUMMARY OF THE INVENTION

The invention is conceived to solve the above-described problems in the related art, and an object of the invention is to provide an inexpensive ink-jet apparatus and a driving method thereof which can produce an ink droplet having a volume necessary for printing, and which can provide superior print quality.

To this end, according to one aspect of the invention, there is provided an ink-jet apparatus comprising an ink chamber which is filled with ink, side walls which form a part of the ink chamber and are partly made of a piezoelectric material, a drive power source for applying an electrical signal to the side walls, and a control unit which causes a pressure wave to develop within the ink chamber by increasing the volume of the ink chamber as a result of applying a jet pulse signal from the drive power source to the side walls, and which causes an ink droplet to be ejected by exerting a pressure on the ink within the ink chamber as a result of decreasing the volume of the chamber from an increased level to a normal level after the lapse of time T during which the pressure wave travels uni-directionally along the ink chamber, wherein the control unit applies a preliminary pulse having a pulse width of 0.3T or less or between (N−0.3)T and (N+0.3)T during which an ink droplet is not ejected, the preliminary pulse also having the same peak value as the jet pulse signal, from the drive source to the side walls before the application of the jet pulse signal to induce the ejecting of an ink droplet, where N is an even number.

According to another aspect of the invention, there is provided a method of driving an ink-jet apparatus comprising an ink chamber which is filled with ink, side walls which form a part of the ink chamber and are partly made of a piezoelectric material, a drive power source for applying an electrical signal to the side walls, and a control unit which causes a pressure wave to develop within the ink chamber by increasing the volume of the ink chamber as a result of applying a jet pulse signal from the drive power source to the side walls, and which causes an ink droplet to be ejected by exerting a pressure on the ink within the ink chamber as a result of decreasing the volume of the chamber from an increased level to a normal level after the lapse of time T during which the pressure wave uni-directionally travels the ink chamber, the control unit applies a preliminary pulse having a pulse width of 0.3T or less or between (N−0.3)T and (N+0.3)T during which an ink droplet is not ejected, the preliminary pulse also having the same peak value as the jet pulse signal, from the drive source to the side walls before the application of the jet pulse signal to induce the ejection of an ink droplet, where N is an even number.

As previously mentioned, according to the ink-jet apparatus and a driving method thereof according to the invention, the control unit applies a preliminary pulse having a pulse width of 0.3T or less or between (N−0.3)T and (N+0.3)T during which an ink droplet is not ejected, the preliminary pulse also having the same peak value as the jet pulse signal, from the drive source to the side walls before the application of the jet pulse signal to induce the ejection of an ink droplet, where N is an even number. As a result, it is possible to preliminarily put a meniscus of the ink droplet forward from a jet nozzle by virtue of variations in the pressure wave before the ink droplet is ejected. The ink droplet is ejected by means of the jet pulse signal, and hence a relatively large ink droplet can be ejected, whereby superior print quality is obtained.

BRIEF DESCRIPTION OF THE DRAWINGS

Preferred embodiments of the invention will be described in detail with reference to the following drawings wherein:

FIG. 6 is a table showing results of an experiment, according to a method of driving the ink-jet apparatus of the invention, which was conducted while the width of a preliminary pulse signal and jet pulse signal application timing were changed;

DETAILED DESCRIPTION OF PREFERRED EMBODIMENTS

With reference to the accompanying drawings, one exemplification which embodies the invention will be described hereinbelow.

Figure 1:
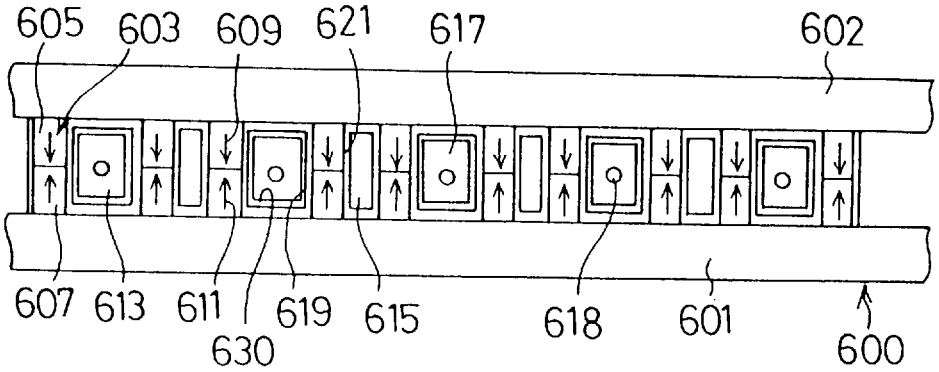
Fig.1 PRIOR ART
FIG. 1 is a schematic representation of an ink-jet apparatus according to both a related art and the invention.
Figure 2:
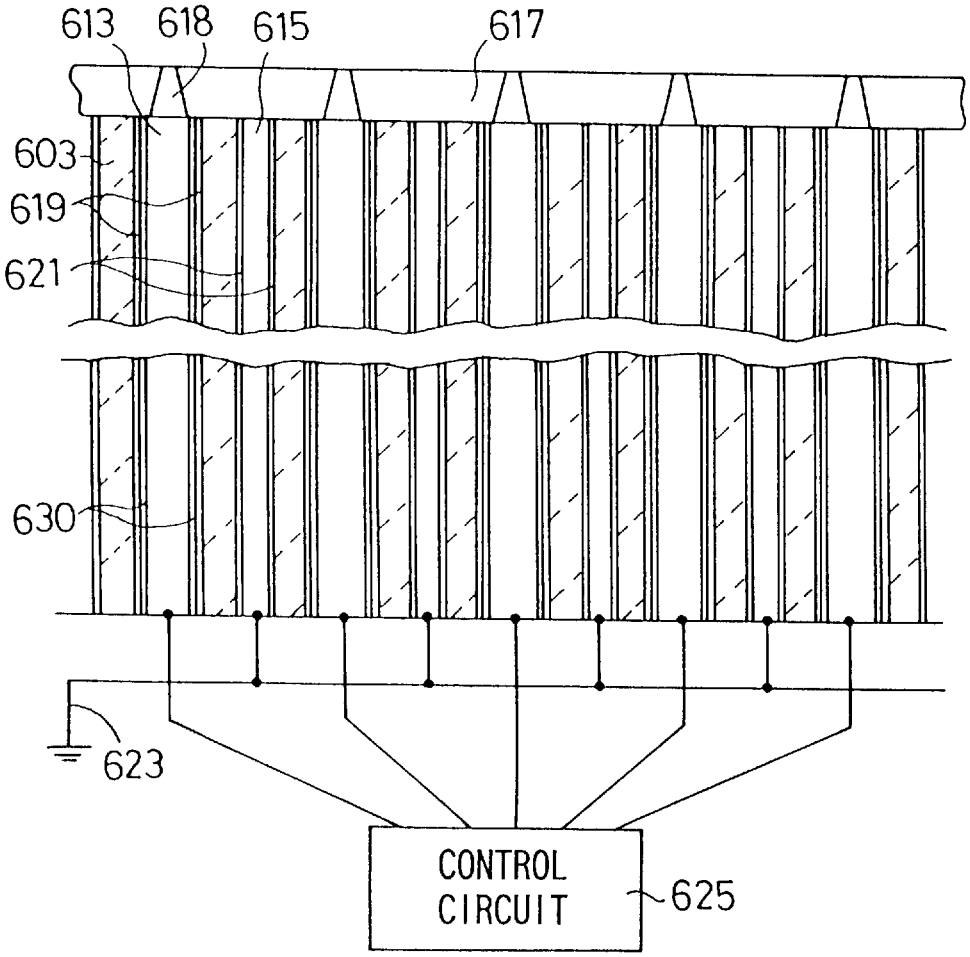
Fig.2 PRIOR ART
FIG. 2 is a schematic representation of an ink-jet apparatus according to both a related art and the invention.
Figure 3:
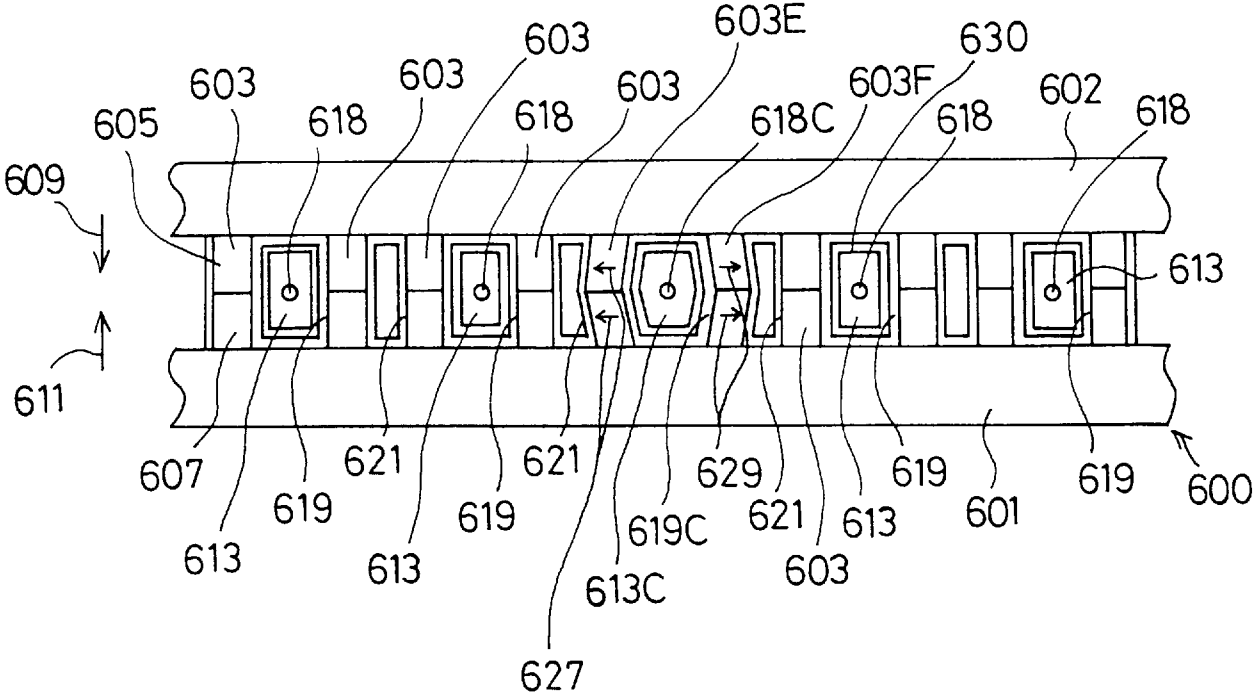
Fig.3 PRIOR ART
FIG. 3 is a schematic representation of an ink-jet apparatus according to both a related art and the invention.
Figure 4:
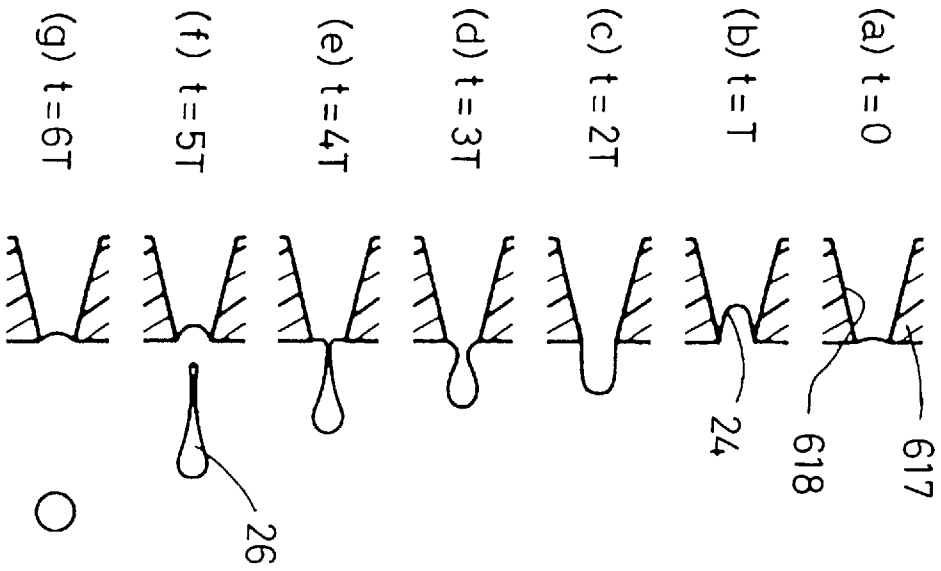
Fig.4 PRIOR ART
FIGS. 4A to 4G are diagrammatic cross sectional views arranged in sequential order of steps A to G of a process for forming an ink droplet by use of a conventional drive waveform.

As with the conventional ink-jet apparatus 600 shown in FIGS. 1 and 2, the ink-jet apparatus 600 of the invention is made up of a bottom wall 601, a top wall 602, and shear mode actuator walls 603 provided between the top and bottom walls. Each actuator wall 603 is further made up of a lower wall 607 which is bonded to the bottom wall 601 and is polarized in the direction designated by an arrow 611, and an upper wall 605 which is bonded to the top wall 602 and is polarized in the direction designated by an arrow 609. A pair of actuator wall pieces 603 form an ink flow passage 613, and a space 615 which is narrower than the ink flow passage 613 is formed between each adjacent pair of actuator walls 603.

A nozzle plate 617 having a nozzle 618 formed therein is fixedly attached to one longitudinal end of each ink flow passage 613. An electrode 619 is formed in the form of a metallized layer on one side of the actuator wall 603, and an electrode 621 is formed, also in the form of a metallized layer, on the other side of the actuator wall 603. The electrode 619 is covered with an insulating layer 630 for insulating the electrode 619 from the ink. The electrode 621 provided so as to face the space 615 is connected to an earth ground 623, and the electrode 619 provided within the ink flow passage 613 is connected to a control circuit 625 which outputs an actuator drive signal.

One specific example of the size of the ink-jet apparatus of the invention will now be described. The length L of the ink flow passage 613 may be 7.5 mm. The diameter of the nozzle 618 close to the ink nozzle may be 40 μm, whereas the diameter of the nozzle 613 close to the ink flow passage may be 72 μm. The length of the ink jet apparatus may be 100 μm. The ink used in the experiment has a viscosity of 2 mPa·s and a surface tension of 30 mN/m. A ratio of the speed of sound "a" in the ink within the ink flow passage 613 to the length L of the ink flow passage 613, that is, L/a (=time T during which a pressure wave uni-directionally travels through the ink flow passage), is 8 μsec.

Figure 5:
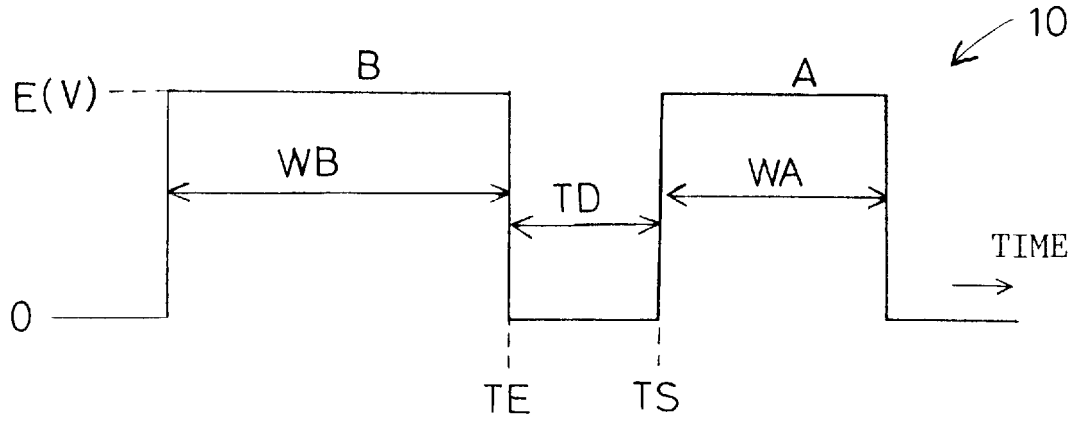
FIG. 5 is a schematic representation of a drive waveform of the ink-jet apparatus according to one embodiment of the invention.

With reference to FIG. 5, a drive waveform 10 applied to the electrode 619 within the ink flow passage 613 of the invention will now be described.

The drive waveform 10 is composed of a preliminary pulse signal B for generating a preliminary pressure wave in the ink flow passage 613 before the ink is ejected, and a jet pulse signal A for ejecting the ink. The preliminary pulse signal B and the jet pulse signal A have the same peak value (a voltage), that is, E (V) (e.g., 20 (V)). A pulse width WB of the preliminary pulse signal B is twice the time T during which the pressure wave uni-directionally travels along the inside of the ink flow passage 613, that is, 16 μsec. A pulse width WA of the jet pulse signal A is identical with the time T (L/a) during which the pressure wave uni-directionally travels along the inside of the ink flow passage 613, that is, 8 μsec. A delay time TD between time TE at which the preliminary pulse signal B drops and time TS at which the jet pulse signal A rises is half the time T during which the pressure wave travels along the inside of the ink flow passage 613, that is, 4 μsec.

Figure 7:
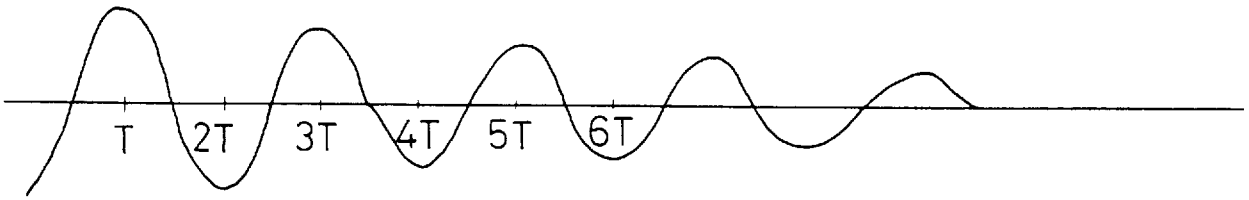
FIG. 7 is a plot showing a waveform of a pressure wave traveling through the inside of an ink flow passage of the ink-jet apparatus of the invention.

The pulse width WB of the preliminary pulse signal B is not necessarily limited to 2T. From results of an experiment shown in FIG. 6, it turns out to be only essential that the pulse width WB of the preliminary pulse signal B be 0.3T or less or between (N−0.3)T and (N+0.3)T, where N is an even number. As can be seen from the waveform of the pressure wave within the ink flow passage 613 as shown in FIG. 7, the pressure wave becomes minimum when NT is an even multiple of T, such as 2T, 4T, and 6T, and it is less likely that the ink will be ejected by a drop in the preliminary pulse signal B. Accordingly, it is only essential that the pulse width WB of the preliminary pulse signal B be within NT±0.3T (N is an even number).

Figure 8:
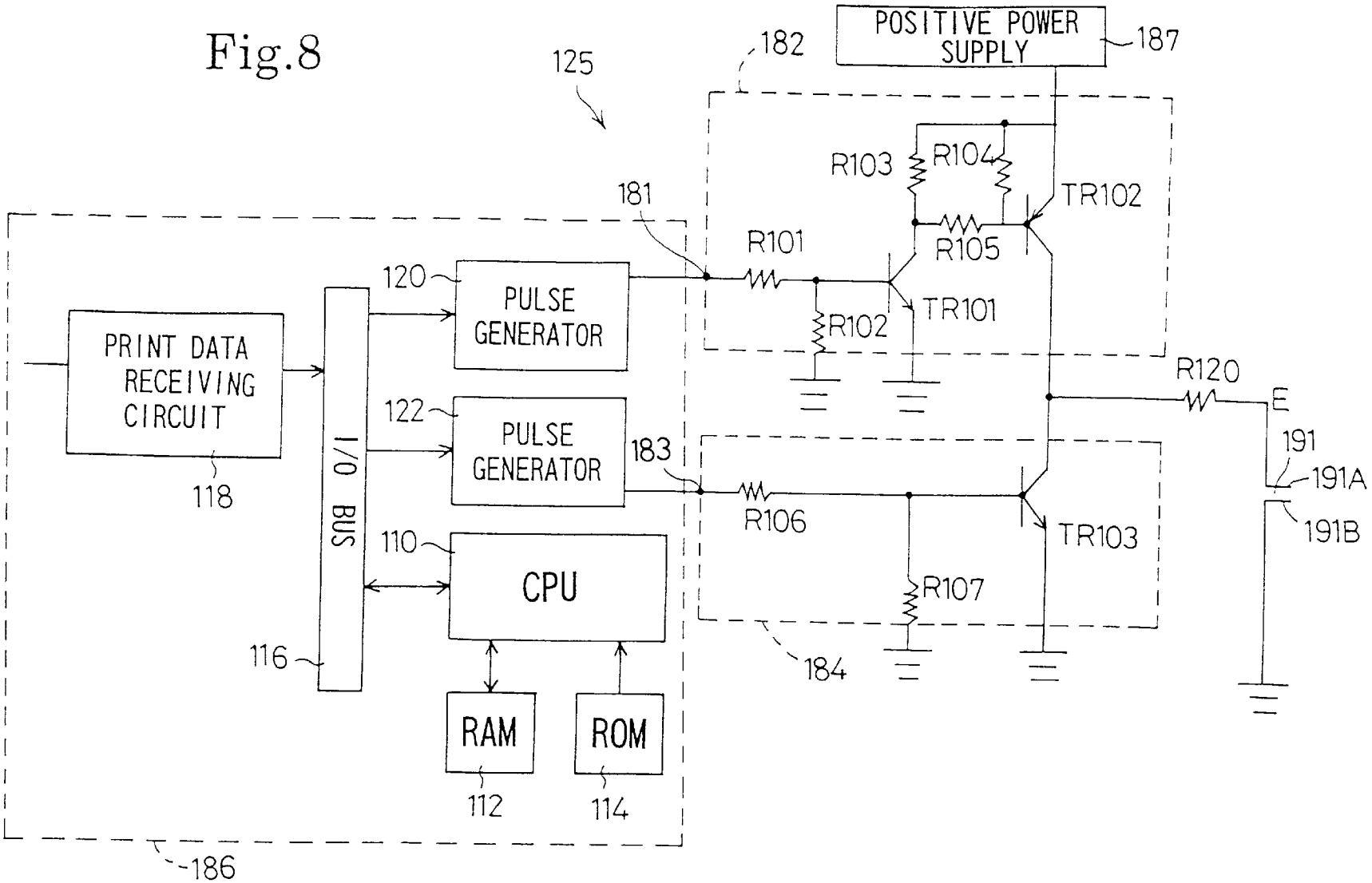
FIG. 8 is a block diagram showing a control circuit of the ink-jet apparatus of the invention.
Figure 9A:
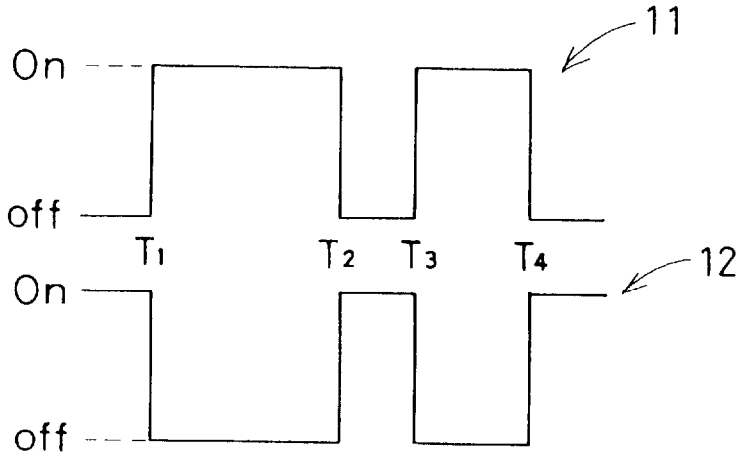
FIGS. 9A and 9B are timing charts for the method of driving the ink-jet apparatus of the invention.
Figure 9B:
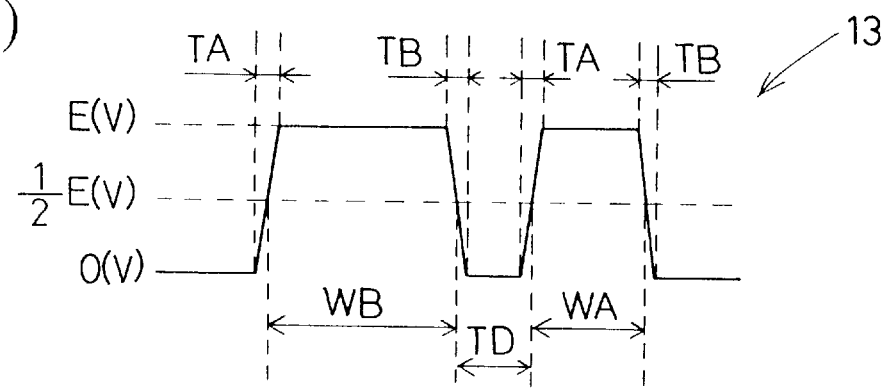

Turning to FIG. 8 and FIGS. 9A and 9B, one embodiment of the control circuit which implements the drive waveform 10 will be described.

The ink-jet apparatus of the present embodiment has the same construction as the conventional ink-jet apparatus 600 as shown in FIGS. 1 and 2. One embodiment of the configuration of the new control circuit 125 that implements the drive waveform 10 will be described referring to FIG. 8.

The control circuit 125 shown in FIG. 8 is made up of a charging circuit 182 for ejecting purposes, a discharging circuit 184, and a pulse control circuit 186.

Input terminals 181 and 183 are used for inputting a pulse signal to set voltages applied to the electrode 619 in the ink flow passage 613 to E (V) and 0 (V).

The charging circuit 182 comprises resistors R101, R102, R103, R104, and R105 and transistors TR101 and TR102.

When the input terminal 181 receives an ON signal (+5V), the transistor TR101 is turned on via the resistor R101. An electrical current flows from a positive power supply 187 via the resistor R103 in the direction from a collector to an emitter of the transistor TR101. Accordingly, a voltage applied to potential divider constituted by the resistors R104 and R105 connected to the positive power supply 187 increases, and the electrical current flowing to the base of the transistor TR102 increases, whereby the emitter and collector of the transistor TR102 are electrically connected together. A voltage of 20 (V) is applied from the positive power supply 187 to a terminal 191A of the output terminal 191 via the collector and emitter of the transistor TR102 and the resistor R120. The voltage is applied from the power supply 187 to the terminal 191A at timings Tl and T3 shown in FIG. 9A. The timing charts shown in FIGS. 9A and 9B show signals input to the input terminals 181 and 183 of the control circuit 125 and a signal output to the output terminal 191.

The discharging circuit 184 will now be described. The discharging circuit 184 is made up of the resistors R106 and R107, and the transistor TR103. When the input terminal 182 receives an ON signal (+5V), a TR103 is turned on via the resistor R106. The terminal 191A of the output terminal 191 connected to a resistor R120 is grounded via the resistor R120. Electrical charges applied to the actuator wall 603 of the ink flow passage 613 shown in FIGS. 1 and 2 are discharged. The electrical charges are discharged at timings T2 and T4 shown in FIG. 9A.

An input signal 11 having a second drive waveform received by the input terminal 181 of the charging circuit 182 is usually in an OFF state as it is illustrated in the timing chart (A) of FIG. 9A. The input signal 11 is turned on at predetermined timing T1 to eject ink, and it is turned off at timing T2. Subsequently, the input signal 11 is turned on at timing T3 and is turned off at timing T4.

A signal 12 received by an input terminal 183 of the discharging circuit 184 is turned off when the input signal 11 is in an ON state (at timings T1 and T3), as shown in the timing chart (B) of FIG. 9B. The signal 12 is turned on when the input signal 11 is in an OFF state (at timings T2 and T4).

An output waveform 13 appearing at the electrode 191A of the output terminal 191 is usually maintained at 0 (V). The actuator wall 603 that is connected to the output terminal 191 and is made of a shear mode piezoelectric element is charged with electrical charges at timing T1. After the lapse of a charging time TA which is determined by the transistor TR103, the resistor R120, and the capacitance of the actuator wall 603 made of the shear mode piezoelectric element, the output waveform 13 becomes a voltage E (V) (e.g., 20(V)). The electrical charges of the actuator wall 603 made of the shear mode piezoelectric element are discharged at timing T2. After the lapse of a discharging time TB which is determined by the transistor TR103, the resistor R120, and the capacitance of the actuator wall 603 made of the shear mode piezoelectric element, the output waveform 13 becomes 0 (V). The actuator wall 603 made of the shear mode piezoelectric element is charged with electrical charges at timing T3. After the lapse of the charging time TA which is determined by the transistor TR102, the resistor R120, and the capacitance of the actuator wall 603 made of the shear mode piezoelectric element, the output waveform 13 becomes the voltage E (V) (e.g., 20(V)). The electrical charges of the actuator wall 603 made of the shear mode piezoelectric element are discharged at timing T4. After the lapse of the discharging time TB which is determined by the transistor TR103, the resistor R120, and the capacitance of the actuator wall 603 made of the shear mode piezoelectric element, the output waveform 13 becomes 0 (V).

In practice, delays TA and TB develop at the leading and falling edges of the drive waveform 13, and therefore the timings T1, T2, T3, and T4 are respectively set in such a way that the pulse width WB and the delay time TD of a preliminary pulse B of the drive waveform 10 at a voltage of ½E (V) become identical with those shown in FIG. 5.

Subsequently, a pulse control circuit 186 for generating a pulse signal, which has the timings T1, T2, T3, and T4 and is received by the input terminal 181 of the charging circuit 182 and the input terminal 183 of the discharging circuit 184, will now be described.

Figure 10:
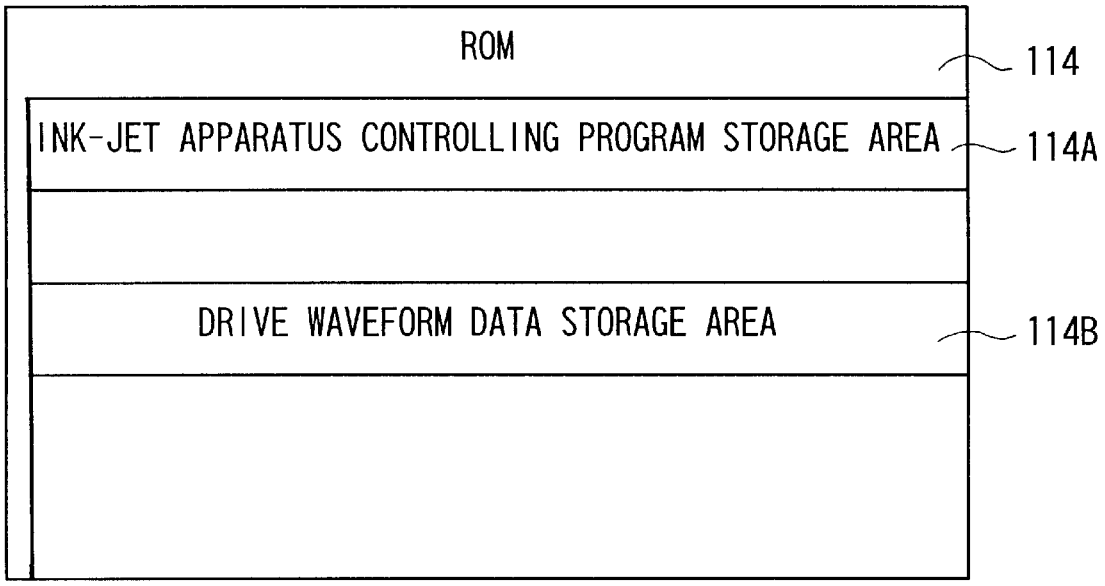
FIG. 10 is a diagrammatic representation of a memory region of ROM of the control circuit of the ink-jet apparatus of the invention.

The pulse control circuit 186 is provided with a CPU 110 for executing a variety of calculations. The CPU 110 is connected to RAM 112 which stores print data and a variety of other data, and ROM 114 which stores a control program of the pulse control circuit 186 and sequence data used for generating turn-on and turn-off signals at the timings T1, T2, T3, and T4. As shown in FIG. 10, the ROM 114 has a program storage area 114A for controlling an ink-jet apparatus and a drive waveform data storage area 114B. Hence, the sequence data of the drive waveform 10 are stored in the drive waveform data storage area 114B.

The CPU 110 is connected to an I/O bus 116, through which a variety of data items are input and output. The I/O bus 116 is connected to a print data receiving circuit 118 and pulse generators 120 and 122. An output of the pulse generator 120 is connected to the input terminal 181 of the charging circuit 182, and an output of the pulse generator 122 is connected to the input terminal 183 of the discharging circuit 184.

The CPU 110 controls the pulse generators 120 and 122 in accordance with the sequence data stored in the pulse drive waveform data storage area 114B. As a result of previously having stored various patterns of the timings T1, T2, T3, and T4 in the drive waveform data storage area 114B in the ROM 114, a drive pulse of the drive waveform 10 shown in FIG. 5 can be applied to the actuator wall 603 made of the shear mode type piezoelectric element. Therefore, it becomes possible to implement the operation and effect of the invention.

The pulse generators 120 and 122, the charging circuit 182, and the discharging circuit 184 are provided in a number corresponding to the number of ink-jet nozzles. In the present embodiment, the control of one nozzle has been described as one representative example. The same description is applicable to the control of other nozzles.

Figure 11:
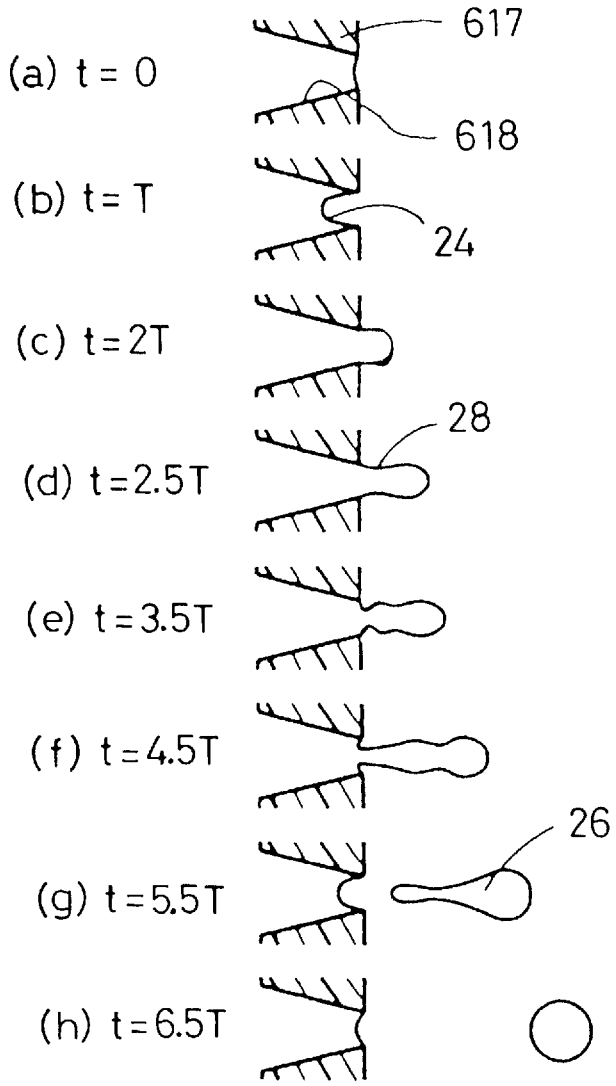
FIGS. 11A to 11H are diagrammatic cross sectional views arranged in sequential order of steps A to H of a process for forming an ink droplet by use of the drive waveform used in the ink-jet apparatus of the invention.

FIGS. 11(*a*) to 11(*h*) are diagrammatic cross sectional views arranged in sequential order of a to h of a process for forming an ink droplet when the drive waveform of the present embodiment is applied to the ink-jet apparatus. On the assumption that the time during which a pressure wave of the ink travels along the inside of the ink flow passage 613 is T, the volume of the ink flow passage 613 increases from an ordinary state thereof to an increased state upon application of the preliminary pulse signal B. The pressure of the ink within the ink flow passage 613 is maintained negative between t=0 and t=T. During this period, the meniscus 24 continues receding and finally deeply recedes into a nozzle 618 as shown in FIG. 11(*b*). According to the theory of propagation of pressure waves, a pressure wave in the vicinity of the nozzle 618 changes to a positive state after the lapse of t=T. The pressure is held in the positive state only between t=T and t=2T, and, thereafter, it becomes negative. The preliminary pulse signal B falls at this moment, and the volume of the ink flow passage 613 is reduced from the increased state to the normal state. The meniscus 24 is temporarily pushed out of the nozzle 618 as shown in FIG. 11(*c*). This is attributable to the fact that the pressure which changes to a negative state at t=2T is already reduced and is smaller than the positive pressure developed as a result of a drop in the preliminary pulse signal B.

The jet pulse signal A is applied to develop a negative pressure around the nozzle 618 by increasing the volume of the ink flow passage 613 from the normal state to the increased state before the meniscus 24 swelling out of the nozzle 618 recedes (at t=2.5T which the pressure around the nozzle 618 still remains positive). However, the meniscus 24 swelling out of the nozzle 618 does not recede, and it becomes a reserve ink droplet 28 connected to the ink within the ink flow passage 613, as shown in FIG. 11(*d*). The pressure wave developed in the vicinity of the nozzle 618 changes to a positive pressure after the lapse of t=3.5T, and eventually the jet pulse signal A drops. A positive pressure developing as a result of a decrease in the volume of the ink flow passage 613 from the increased state to the normal state is added to the positive pressure changed from the negative state, whereby the meniscus 24 is pushed forward in such a way as to further push the reserve ink droplet 28 from behind. Then, as shown in FIG. 11(*h*), a relatively large ink droplet 26 is ejected from the nozzle 618.

With reference to a table shown in FIG. 6, results of the ink-jet test obtained when the ink-jet apparatus was driven according to the drive method of the invention will now be described.

When the ink-jet apparatus was driven at a drive voltage of 20 (V) according to the driving method of the present embodiment, there were obtained an ink droplet speed of 5 m/s and an ink droplet volume of 45 pl. As a comparison, when the ink-jet apparatus was driven using only the jet pulse signal A of the drive waveform of the present embodiment, there were obtained an ink-jet velocity of 4.5 m/s and an ink droplet volume of 25 pl. Further, when the drive voltage of the comparative test was set to 21 (V) in such a way that the ink droplet jet velocity becomes 5 m/s, the volume of the ink droplet was 26 pl.

According to the driving method of the present embodiment, an increase in the ink droplet jet velocity and the ink droplet volume is acknowledged.

Results of the test conducted in order to obtain the pulse width WB of the preliminary pulse signal B, and an appropriate range of the delay time TD between time TE at which the preliminary pulse B drops and time TS at which the jet pulse signal A rises will now be described.

The table shown in FIG. 6 shows results of evaluation of the data obtained when the pulse width WB of the preliminary pulse signal B was changed in the range between 0.3T and 7.0T, and the delay time TD between the time TE at which the preliminary pulse signal B drops and the time TS at which the jet pulse signal A rises was changed in the range between 0.3T and 3.0T. Evaluation was carried out by measuring an ink-jet velocity and an ink volume obtained when the ink-jet apparatus was driven at a voltage of 20 (V). If an ink droplet was ejected by the preliminary pulse signal B, the result was indicated as "X".

From these results, it can be seen that there is no substantial change in the ink droplet jet velocity and the ink droplet volume when the delay time TD between the TE at which the preliminary pulse signal B falls and the time TS at which the jet pulse signal A rises is changed in the range of 0.3T to 3.0T. When the pulse width WB of the preliminary pulse signal B was set to 0.3T or less, between 1.7T and 2.3T, between 3.7T and 4.3T, and between 5.7T and 6.3T, the second pulse signal B did not cause an ink droplet to be ejected. It can be also seen that the ink droplet jet velocity changes in as small a range as between 4.8 and 5.1 m/s, and the ink droplet volume also changes in as small a range as between 43 and 47 pl. Therefore, an ink-jet apparatus which provides a superior print result can be implemented.

Although one embodiment of the ink-jet apparatus and the driving method thereof according to the invention have been described in detail, the invention is not limited to this embodiment. For example, if the directions of polarization of the upper and lower walls designated by the arrows 609 and 611 shown in FIG. 7 are inverted, a negative power supply may be employed instead of the positive power supply 187.

Figure 12:
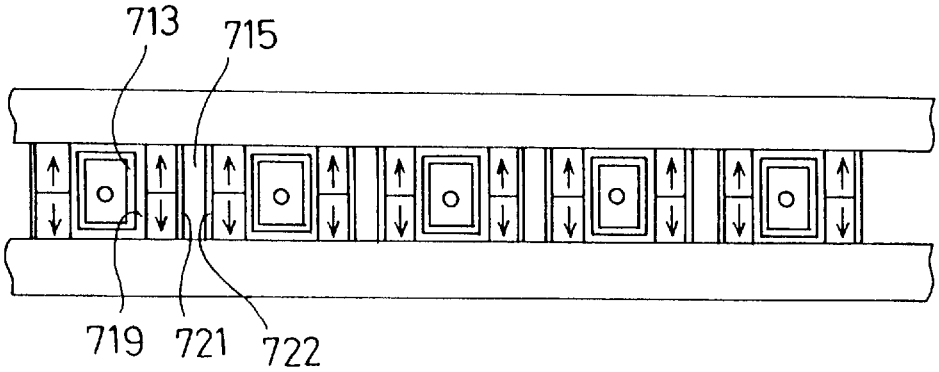
FIG. 12 is a schematic representation of an ink-jet apparatus according to another embodiment of the invention.

Moreover, provided that the directions of the polarization of the upper and lower walls are inverted as shown in FIG. 12, that the electrode 719 provided in the ink flow passage 713 is grounded, and that the electrode provided in the space 715 is divided into two electrodes 721 and 722, it may be possible to connect the electrode 721 to the terminal 191A of the output terminal 191 connected to the resistor R120 shown in FIG. 8, and connect the other electrode 722 to a terminal of an output terminal connected to another resistor of another charging circuit (which is not shown in the drawings).

In the above-described embodiment, the ink was ejected as a result of variations in the volume of the ink flow passage 603 caused by piezoelectric deformation of the lower and upper walls 607 and 605 of the actuator wall 603. It may be possible to eject the ink by forming either the upper or lower wall from material which does not undergo piezoelectric deformation in such a way as to be deformed in association with the piezoelectric deformation of the remaining wall.

Although the air chambers 615 are provided on both sides of the ink flow passage 603 in the present embodiment, the ink flow passages may be disposed side by side without the air chambers.

It should be noted that other modifications or improved embodiments of this embodiment are obvious for those skilled in the art.

What is claimed is:

1. A method of driving an ink-jet apparatus including an ink chamber filled with ink, side walls which form a part of said ink chamber and are at least partly made of a piezoelectric material, and a control unit which causes a pressure wave to develop within the ink chamber by increasing a volume of said ink chamber by applying a jet pulse signal from a drive power source to said side walls causing an ink droplet to be ejected by exerting a pressure on the ink within the ink chamber as a result of decreasing the volume of said ink chamber after a lapse of time T during which the pressure wave uni-directionally travels along said ink chamber, the method comprising the steps of:

applying a preliminary pulse signal to said side walls to generate a preliminary pressure wave along the ink chamber, the preliminary pulse signal having a same peak value as the jet pulse signal, the preliminary pulse not causing ink droplets to be ejected, and then applying the jet pulse signal causing the ink droplets to be ejected.

2. The method of driving an ink-jet apparatus as defined in claim 1, wherein the step of applying the preliminary pulse signal comprises applying a pulse signal having a pulse width that is 0.3T or less.

3. The method of driving an ink-jet apparatus as defined in claim 1, wherein the step of applying the preliminary pulse signal comprises applying the preliminary pulse signal having a pulse width that is in a range of NT−0.3T to NT+0.3T, where N is an even number.

4. The method of driving an ink-jet apparatus as defined in claim 1, wherein the step of applying the jet pulse signal comprises applying the jet pulse signal 0.5T after said preliminary pulse signal falls.

5. The method of driving an ink-jet apparatus as defined in claim 2, wherein the step of applying the jet pulse signal comprises applying the jet pulse signal 0.5T after said preliminary pulse signal falls.

6. The method of driving an ink-jet apparatus as defined in claim 3, wherein the step of applying the jet pulse signal comprises applying the jet pulse signal 0.5T after said preliminary pulse signal falls.

7. An ink-jet apparatus comprising:

an ink chamber filled with ink;

side walls which form a part of said ink chamber being at least partly made of a piezoelectric material;

a drive power source; and a control unit which causes a pressure wave to develop within the ink chamber by increasing a volume of said ink chamber by applying a jet pulse signal from said drive power source to said side walls causing an ink droplet to be ejected by exerting a pressure on the ink within the ink chamber as a result of decreasing the volume of said ink chamber after a lapse of a time period T during which the pressure wave uni-directionally travels said ink chamber, said control unit applying a preliminary pulse signal from said drive source to said side walls to generate a preliminary pressure wave along the ink chamber, the preliminary pulse having a same peak value as the jet pulse signal and not causing ink droplets to be ejected, said control unit then applying the jet pulse signal causing the ink droplets to be ejected.

8. The ink-jet apparatus as defined in claim 7, wherein a pulse width of said preliminary pulse signal is 0.3T or less.

9. The inkjet apparatus as defined in claim 7, wherein a pulse width of said preliminary pulse signal is in a range of NT−0.3T to NT+0.3T, where N is an even number.

10. The ink-jet apparatus as defined in claim 7, wherein said jet pulse signal is applied 0.5T after said preliminary pulse signal falls.

11. The ink-jet apparatus as defined in claim 8, wherein said jet pulse signal is applied 0.5T after said preliminary pulse signal falls.

12. The ink jet apparatus as defined in claim 9, wherein said jet pulse signal is applied 0.5T after said preliminary pulse signal falls.

13. A method of increasing a volume of ink droplets ejected from a piezoelectric ink-jet printer, the piezoelectric ink-jet printer including an ink chamber filled with ink and having side walls at least partly made of a piezoelectric material, and a control unit that applies a jet pulse signal to said side walls causing ink droplets to be ejected by increasing and then decreasing a volume of said ink chamber after a lapse of a time period T during which a pressure wave uni-directionally travels along said ink chamber, the method comprising the steps of:

applying a preliminary pulse signal to said side walls so that a preliminary pulse wave generated within said ink chamber causes a meniscus of ink to protrude from nozzles of said ink chamber without being ejected from said nozzles, the preliminary pulse signal having a same peak value as the jet pulse signal; and then applying the jet pulse signal to said side walls causing ink droplets of increased volume to be ejected.

14. The method of increasing a volume of ink droplets ejected from a piezoelectric ink-jet printer as defined in claim 13, wherein the step of applying said preliminary pulse signal comprises applying the preliminary pulse signal with a pulse width that is 0.3T or less.

15. The method of increasing a volume of ink droplets ejected from a piezoelectric ink-jet printer as defined in claim 13, wherein the step of applying the preliminary pulse signal comprises applying the preliminary pulse signal with a pulse width in the range of NT−0.3T to NT+0.3T, where N is an even number.

16. The method of increasing a volume of ink droplets ejected from a piezoelectric ink-jet printer as defined in claim 13, wherein the step of applying the jet pulse signal comprises applying the jet pulse signal 0.5T after said preliminary pulse signal falls.

17. A piezoelectric ink-jet apparatus comprising:

an ink chamber filled with ink having side walls at least partly made of a piezoelectric material; and a control unit that applies a jet pulse signal to said side walls causing ink droplets to be ejected by increasing and then decreasing a volume of said ink chamber after a lapse of a time period T during which a pressure wave uni-directionally travels along said ink chamber, said control unit applying a preliminary pulse signal to said side walls so that a preliminary pulse wave generated within said ink chamber causes a meniscus of ink to protrude from nozzles of said ink chamber without being ejected from said nozzles, the preliminary pulse signal having a same peak value as the jet pulse signal, and then applying the jet pulse signal causing ink droplets of increased volume to be ejected.

18. The piezoelectric ink-jet apparatus as defined in claim 17, wherein a pulse width of said preliminary pulse signal is 0.3T or less.

19. The piezoelectric ink-jet apparatus as defined in claim 17, wherein a pulse width of said preliminary pulse signal is in a range of NT−0.3T to NT+0.3T, where N is an even number and said jet pulse signal is applied 0.5T after said preliminary pulse signal falls.

20. The piezoeletric ink-jet apparatus as defined in claim 17, wherein said control unit comprises:

a pulse control circuit including a CPU, a RAM connected to the CPU and storing print data, a ROM connected to the CPU and storing control programs, a print data receiving circuit connected to the CPU for receiving print data, and at least one pulse generator circuit connected to the CPU for generating pulse signals;

a charging circuit connected between the at least one pulse control circuit and an electrode connected to said side walls for applying a charge signal to said electrode; and a discharging circuit connected between said at least one pulse generator and said electrode for discharging the charge signal.

* * * * *